United States Patent [19]

Legille et al.

[11] 4,273,492

[45] Jun. 16, 1981

[54] CHARGING DEVICE FOR SHAFT FURNACES

[75] Inventors: Edouard Legille, Luxembourg; Pierre Mailliet, Howald, both of Luxembourg

[73] Assignee: Paul Wurth, S.A., Luxembourg

[21] Appl. No.: 65,289

[22] Filed: Aug. 9, 1979

[30] Foreign Application Priority Data

Aug. 16, 1978 [LU] Luxembourg ..... 80112

[51] Int. Cl.[3] ..... C21B 7/16

[52] U.S. Cl. ..... 414/160; 414/206

[58] Field of Search ..... 266/265; 414/199, 205, 414/206, 207, 160

[56] References Cited

U.S. PATENT DOCUMENTS

| | | | |
|---|---|---|---|
| 1,668,968 | 5/1928 | Lambot | 414/206 |
| 3,693,812 | 9/1972 | Mahr et al. | 414/206 |
| 3,814,403 | 6/1974 | Legille | 414/206 |
| 3,880,302 | 4/1975 | Legille | 414/206 |
| 3,899,088 | 8/1975 | Furuya et al. | 414/206 |
| 4,042,130 | 8/1977 | Legille et al. | 414/199 |

FOREIGN PATENT DOCUMENTS 1441298 6/1976 United Kingdom .

*Primary Examiner*—Donald L. Walton

*Attorney, Agent, or Firm*—Fishman and Van Kirk

[57] ABSTRACT

A furnace charging device with a fixed feed channel is positioned in the center of the furnace head. A distribution spout is pivotably supported under the fixed feed channel and has a control rod attached to the spout. A driving means is provided so that the control rod which consist of two telescopic elements may be lengthened or shortened and at the same time may be rotated along with the spout as one assembly around the vertical axis of the furnace.

15 Claims, 9 Drawing Figures

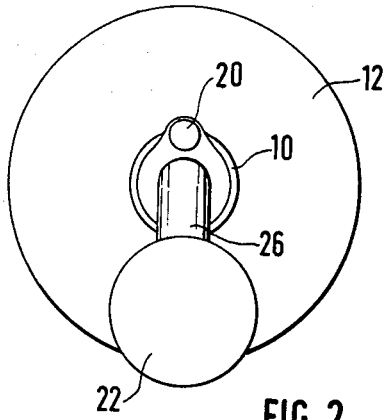
FIG. 2
FIG. 3
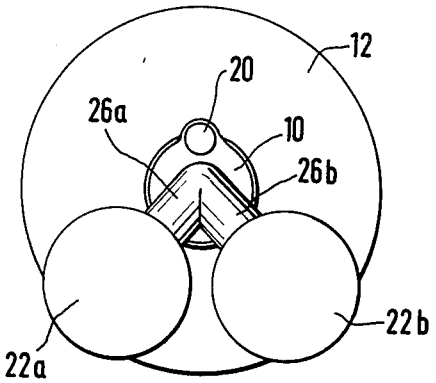

64
90
92
88
82
56

64
R
α
86
82
80
VI
84
56
62
60
58
48
β
γ
32

38
34
40
72
36
68
73
70
80
82
84
66
64
86
94
56
62
28
60
58
16
48

CHARGING DEVICE FOR SHAFT FURNACES

BACKGROUND OF THE INVENTION (1) Field of the Invention

The present invention relates to charging devices for shaft furnaces which have a fixed feed channel positioned vertically in the centre of the furnace head. More particularly, this invention is directed to charging devices including a rotary ferrule mounted coaxially around the said feed channel, a substantially cylindrical fixed wall mounted coaxially outside the said ferrule, in conjunction with which it laterally and internally delimits a substantially cylindrical and annular chamber, this chamber being separated but not isolated from the interior of the furnace by means of an annular disc integral with the rotary ferrule, a distribution spout pivotably mounted at the base of the rotary ferrule, a control rod articulated to the spout and penetrating the said chamber via the annular disc, a first driving means serving to cause the ferrule, annular disc, spout and control rod as to rotate as one assembly around the vertical axis of the furnace and of the feed channel, and a second driving means serving to pivot the spout by means of the control rod, independently of the movement resulting from the action of the first driving means, around the horizontal shaft by which it is suspended from the ferrule.

(2) Description of the Prior Art

Furnace charging devices with a rotary spout or chute of which the pouring angle is adjustable are at present well known in the branch of industry concerned. The success of charging systems employing such rotatable and angularly adjustable distribution chutes is due firstly to the fact that they have made it possible to surpass the operating limits already achieved some time previously with the conventional bell-type charging devices and secondly to the fact that such systems enable the charging operation and therefore the actual operation of the furnace to be controlled more satisfactorily.

The movement i.e., the aiming, of the spout is generally brought about through the use of by two separate motors. The output shaft rotation of these motors is converted into rotary and pivotal spout motion by recourse to contrivances based on the use of wheels and gearings, particularly those performing differential and planetary movements. These driving mechanisms are required to be capable of guiding the spout to aim the charge material, which falls under the influence of gravity, to any arbitrary point on the charging surface and of enabling the material to be deposited in clearly defined configurations capable of contributing to the optimization of the furnace operation.

The numerous charging devices of this type essentially fall into two categories, according to the mechanism used for adjusting the pouring angle of the spout. The first type is based on the use of a control rod articulated to the spout and caused to perform an ascending or descending movement in order to pivot the spout around its horizontal suspension shafts, while in a second type of charging device the horizontal suspension shaft of the spout are itself caused to perform rotary movements.

The devices included in the first of the above-mentioned categories, is exemplified by the disclosure of U.S. Pat. No. 3,864,984 and British Pat. No. 1,322,798. Among the advantages offered by devices of the type disclosed in the above-mentioned U.S. patent is the relatively moderate width of the annular chamber in which the control rod moves. Among the major drawbacks of this type device is of the comparatively complex mechanisms required for the purpose of superimposing on the gyratory movement of the control rod, around the admission chamber, a vertical translatory movement serving to set up the pivoting motion of the spout in relation to the vertical axis. It should further be noted that while numerous mechanisms of the general type disclosed in U.S. Pat. No. 3,864,984 have been proposed, either in technical articles or in patents or patent applications, no device of this kind has so far been actually constructed and employed, the experts in this branch of industry having placed more confidence in those of the second category discussed.

An example of steerable charging devices of the second category, i.e., devices wherein the angular spout adjustment is achieved through rotation of the horizontal suspension shafts of the spout, is described in detail in the British Patent specification 1403687. In devices of the type described in this British patent the operation of adjusting the pouring angle of the spout is performed by means of two gear boxes positioned symmetrically, at the two ends of the spout suspension shaft, in the annular chamber around the vertical feed channel, the gear boxes gravitating about the feed channel. Charging devices of this type have been actually put into operation in numerous blast furnaces, particulary those of the modern high-capacity type. Among the points to be mentioned in favour of this type of device is the fact that all the movements are generated and transmitted by gearings, i.e. efficient, simple and reliable means, of which the forces are applied to the spout symmetrically. However, the need for two gear boxes gravitating around the feed channel necessarily increases the width of the annular chamber in which the gear boxes move and also increases the width of the annular disc separating the feed channel from the interior of the furnace. In other words, the surface exposed to the temperature prevailing in the furnace has an ample area, necessitating additional cooling for the annular chamber and for the driving devices housed therein, such cooling being achieved by the circulation of cooled inert gas. While the advantages of charging devices of the type being discussed justify installation of such devices in modern high-performance blast furnaces, the cost and the auxiliary equipment required render the use of these controllable charging devices less advantageous in the case of furnaces of medium and low capacity.

SUMMARY OF THE INVENTION

The purpose of the present invention is to provide a controllable charging device which will combine the advantages of the devices of each of the two known above-described categories, i.e. a charging device of which the driving mechanisms consist of only a few elements, operating in a simple and reliable manner, occupying only a moderate amount of space and rendering auxiliary cooling by means of an inert gas unnecessary, the cost of the device and the required auxiliary equipment rendering it equally suitable for low capacity and for high-capacity furnaces.

According to the present invention there is provided a charging device for shaft furnaces, comprising a fixed feed channel positioned vertically in the centre of the furnace head, a rotary ferrule mounted coaxially around the said feed channel, a substantially cylindrical fixed wall mounted coaxially outside the said ferrule, in conjunction with which it laterally and internally delimits a substantially cylindrical and annular chamber, this chamber being separated but not isolated from the interior of the furnace by means of an annular disc integral with the rotary ferrule, a distribution spout pivotably supported from the rotary ferrule, a control rod articulated to the spout and penetrating the said chamber via the annular disc, a first driving means serving to cause the ferrule, annular disc, spout and control rod as to rotate as one assembly around the vertical axis of the furnace and of the feed channel, and a second driving means serving to pivote the spout by means of the control rod, independently of the movement resulting from the action of the first driving means, around the horizontal shaft by which it is suspended from the ferrule, wherein the control rod consists of two telescopic elements, of which the upper one is suspended from the ferrule by joint, and of a means for lengthening and shortening the said rod, said means being controlled by the second driving means.

The upper element of the control rod advantageously consists of an Archimedean screw penetrating the lower element in the form of a socket.

The wall of the feed channel is preferably double, to form an annular compartment capable of accommodating a liquid coolant. Similarly, the rotary ferrule, as well as the annular disc, can be made double walled, in order to enable a liquid coolant to circulate therein.

The first and the second driving means comprise two juxtaposed and coaxial pinions in the annular chamber, which are mounted on concentric driving shafts passing through the wall of the chamber, each pinion interacting with one of two toothed rims or ring gears surrounding the feed channel and mounted on a bearing in such a way that each pinion can rotate independently of the other and both pinions can rotate with respect to the stationary feed channel, one of these toothed rims being integral with the ferrule and the other forming a drive gear connected to the Archimedean screw of the telescopic control rod.

Since the principal active elements in the annular chamber are positioned one above the other, the chamber width can be minimized. It follows that the width of the lower disc, which functions as a heat shield, is likewise minimized, so that the area exposed to the heat prevailing in the furnace is comparatively small. As it is also possible to reduce the thermal radiation to the interior of the annular chamber by the circulation of a cooling liquid in the walls of the feed channel, and possibly the ferrule and the disc likewise, it is no longer necessary to inject a cooling gas into the said chamber.

Since, moreover, the control rod is telescopic and thus does not have to undergo an ascending and descending movement, the annular chamber can likewise be made of shorter axial length than that of installations already known. This naturally affects the total height of the installation, such a reduction in height being a well known advantage of particular value.

BRIEF DESCRIPTION OF THE DRAWING

Further features and advantages will emerge from the following detailed description of one embodiment of the invention, given by way of an example, by reference to the accompanying drawings, wherein:

FIG. 2 is a schematic diagram of the top of an installation corresponding to the view provided by FIG. 1 and with one single storage chamber.

FIG. 3 provides a view, corresponding to FIG. 2, of an installation having two storage chambers.

DESCRIPTION OF THE PREFERRED EMBODIMENTS

The following detailed description will refer more particularly to a blast furnace. It should nevertheless be noted that the invention is not limited to this type of furnace but may be applied to other types of shaft furnace.

Figure 1:
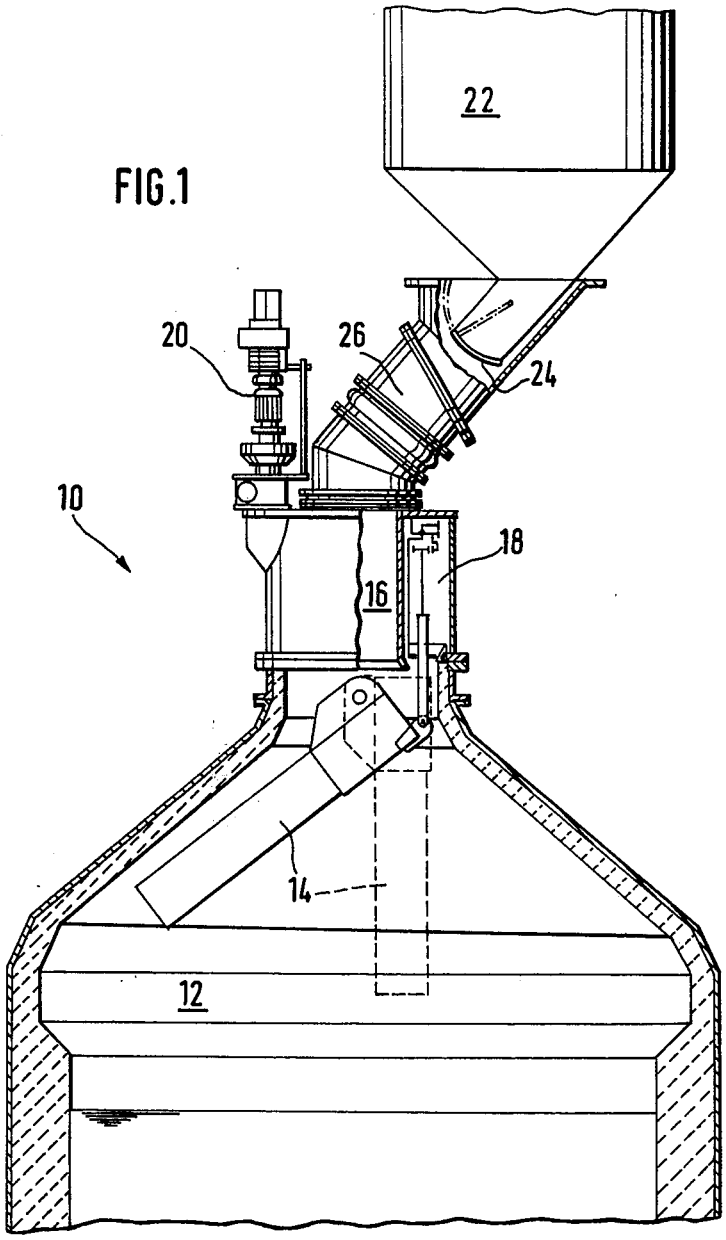
FIG. 1 is a general schematic diagram of a blast furnace charging installation employing a charging device according to the invention.

In FIG. 1 the item marked 12 is the head of a blast furnace, more commonly known by the term "mouth".

The furnace is fed by means of a charging device 10 comprising a vertical feed channel 16 underneath which is mounted a distribution spout 14. This spout 14 is caused to rotate about the vertical axis of the furnace and to tilt between the position shown in full lines and the position shown in broken lines by means of a suitable mechanism accommodated in an annular chamber 18 and controlled by a motor unit 20 provided outside the said chamber 18. The material with which the furnace is to be charged is released from one or more hermetically sealable storage hoppers 22 and flows, according to the position of a dosing valve 24, through an intermediate channel 26 and the feed channel 16, onto the distribution spout 14.

FIGS. 2 and 3 provide schematic views, from above of an installation in accordance with FIG. 1, comprising respectively a single hopper chamber 22 and two storage hoppers **22*a*, 22*b*. In the case of the version having two storage hoppers 22*a* and 22*b*, the latter are preferably positioned as shown in FIG. 3 with the two corresponding intermediate channels 26*a* and 26*b* defining a U-shaped feeding system. Other reference numbers appearing in FIGS. 2 and 3 identify the same elements corresponding to those of FIG. 1**.

The arrangement shown in FIG. 3 is more particularly suitable for high-capacity blast furnaces. In this case the two storage chambers alternate with each other in their operation, i.e. one is filled while the other is being emptied.

Both the arrangement shown in FIG. 2 and that illustrated in FIG. 3 ensure easy and rapid access to the driving mechanism for the distribution spout 14, particularly for the purpose of dismantling this latter. Thus by means of a lifting device, such as a crane or travelling crane mounted above the furnace, the entire charging device 10 can be rendered accessible by raising it from its seating, this operation being unimpeded by the storage chamber or chambers.

It is nevertheless also possible to remove the spout 14, in the conventional manner, via an opening provided in the conical part of the furnace head and not shown in the drawing, if for constructional reasons the solution proposed above is not desired or proves impracticable.

As regards the arrangement illustrated in FIG. 3 it should be noted that the juxtaposition of the two storage chambers 22*a* and 22*b*, in addition to affording access to the charging device 10, facilitates and simplifies access to these chambers themselves, for the purpose of filling them by means of a belt- skip or bucket- conveyor.

For the detailed description of the mechanism for moving the distribution spout 14, FIGS. 4–7 should be referred to simultaneously. As in other charging devices the distribution spout is suspended by two pivots 32 from two brackets 30 mounted symmetrically on a rotary cylindrical ferrule 28 positioned outwardly from and coaxial with the vertical feed channel 16. The rotation of this ferrule 28 causes the spout 14 to turn about the longitudinal axis O of the furnace. In order to enable ferrule 28 to rotate about the axis of stationary feed channel 16, the upper end of ferrule 28 is attached, as shown in detail in FIG. 7, to an annular bearing block 34. Bearing block 34 is in turn mounted, by means of a ball bearing or roller bearing 36, on the fixed frame formed by the wall 38 of the charging device. The bearing block 34, and consequently the ferrule 28 are therefore able to turn freely with respect to the feed channel 16. To produce this rotation the bearing block 34 is provided with a toothed wheel 40 which meshes with a first driving pinion 42. Pinion 42 is affixed to a shaft 44 which, in turn, is accommodated in a bearing 46 mounted in the wall 38 of the charging device 10.

Figure 4:
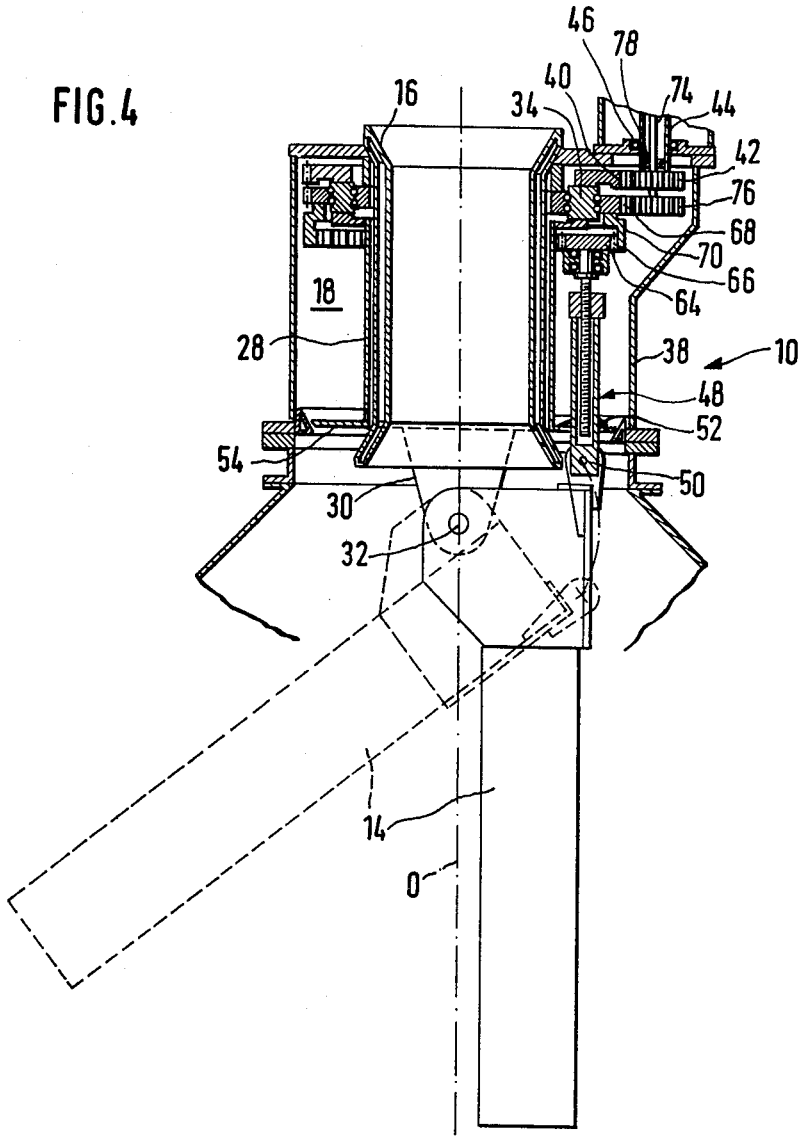
FIG. 4 is a schematic diagram of a first embodiment of a driving mechanism for the feed spout of FIG. 1 according to the present invention.

The second movement of the distribution spout 14, i.e. the tilting movement about the pivots 32, from a vertical position, shown in full lines in FIG. 4, to a peripheral pouring position, as shown in broken lines in FIG. 4, is generated by a control rod 48 articulated to a lug 50. Lug 50 is affixed to the upper rear part of the spout 14. This control rod 48 gravitates about the feed channel together with the ferrule. For this purpose it penetrates the lower end of annular control chamber 18 via an aperture 52 provided in an annular disc 54 integral with the ferrule 28. Disc 54 forms a heat shield serving to protect the interior of the control chamber 18 from the high temperature prevailing in the head of the blast furnace. To render this protection as effective as possible, the gap between the rotary disc 54 and the fixed parts, particularly the lower portion of wall 38 of the charging device, is made as narrow as it is possible to make it without impeding the rotation of the disc 54.

Figures 5, 6:
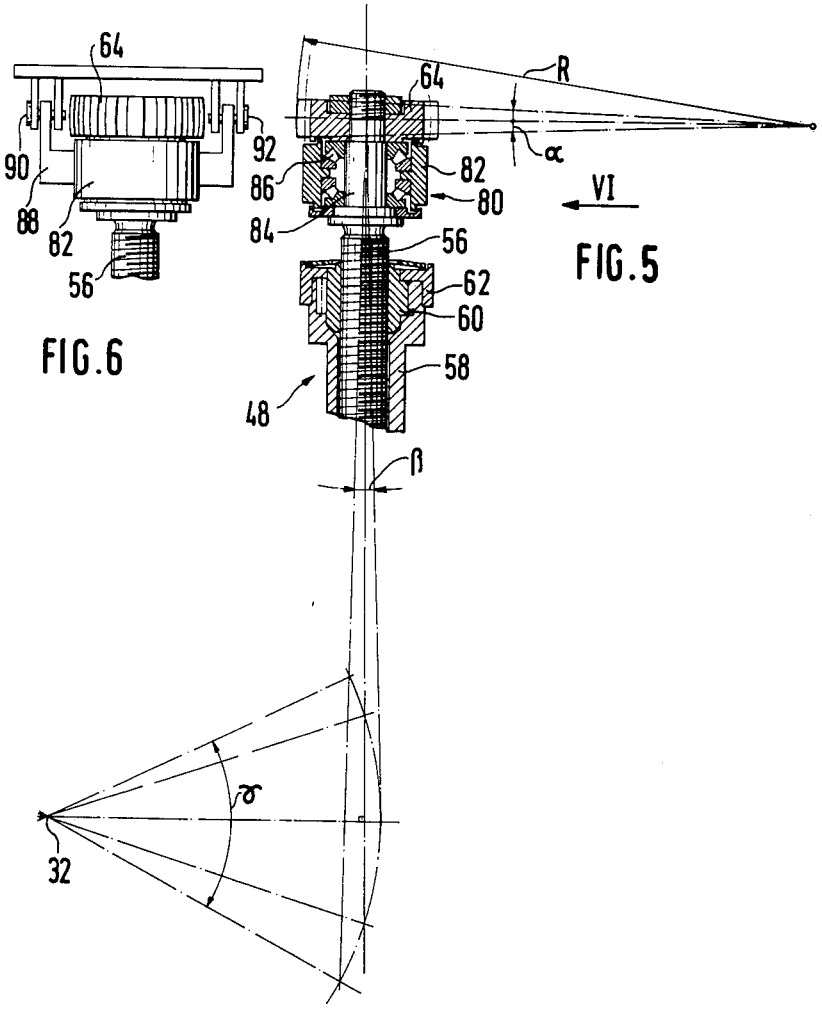
FIG. 5 is a partial section through a first version of the suspension of the control rod of the FIG. 4 embodiment.
FIG. 6 is a schematic diagram of the control rod suspension system as viewed in the direction indicated by the arrow VI of FIG. 5.
Figure 7:
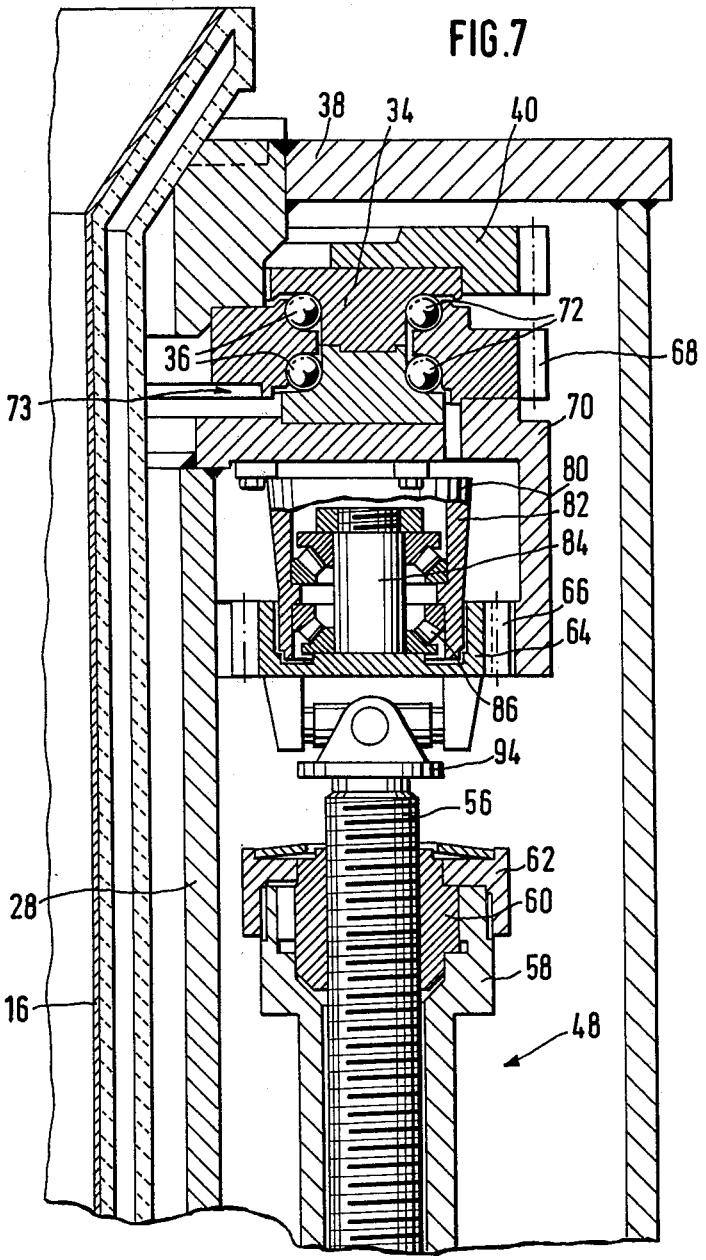
FIG. 7 is a schematic section through a second version of the suspension of the control rod of the FIG. 4 embodiment in accordance with the present invention.

According to the invention, as least seen from FIG. 7, the control rod 48 consists of two telescopic elements, i.e. an element 56 taking the form of an Archimedean screw and an element 58 in the form of a socket. This socket 58 is provided with bronze nut 60 having an internal screw threading corresponding to that of the Archimedean screw 56. Accordingly, rotation of screw 56, according to the direction which it takes, results either in an ascending or descending movement of nut 60 and thus of the socket 58. Since socket 58 is directly coupled to spout 14 via the lug 50, a corresponding pivoting movement of the distribution spout 14 results. The bronze nut 60 is rendered integral with the socket 58, which is comprised of refractory steel by means of a removable collar 62 (see FIGS. 5 and 7) attached to the upper end of the socket 58. This composite structure of the control rod 48 is more advantageous than a simpler structure with an internal screw threading for the socket 58, since the necessity of making screw 58 from refractory steel renders it unsuitable for the functions of the bronze nut 60. The above-described construction also facilitates the task of dismanteling the control rod 48, and particularly that of disconnecting the socket 58, as it is not necessary to turn one or other of the elements 56 and 58 until it is completely released. Instead, all that is required to decouple the components of control rod 48 is to release the removable securing system between the socket 58 and its collar 62.

In order to generate a rotary movement of the Archimedean screw 56 about its own longitudinal axis, screw 56 is made rotationally integral with a toothed wheel 64. Wheel or gear 64 meshes with one of the lower set of teeth 66 of a double toothed rim 70. The upper set of teeth 68 of rim 70 meshes with a second pinion 76 juxtaposed to and positioned below the pinion 42. The toothed rim 70 is mounted, by means of a ball bearing or roller bearing 72 in the bearing block 34. The two bearings 36 and 72, form a special differential bearing indicated generally at 73. This bearing 73, which is very compact, is one of the special features of the present invention. In prior art devices use has invariably been made of two adjacent and different bearings for the purpose of transmitting independent and superimposed movements. On the other hand the double bearing 73 provided in the device to which the present invention relates not only enables the number of different components, and consequently the cost of the apparatus to be reduced but also results in a reduction of the space occupied, particularly as regards the height. The pinion 76, like the pinion 42, is integral with a motor shaft 74 arranged coaxially inside the above-mentioned shaft 44. The shaft 44 and the shaft 74 are rendered rotatable independently of each other by means of a bearing 78 situated therebetween. The two shafts 44 and 74 are driven independently of each other, as will be described in greater detail by reference to FIG. 9, by means of the motor unit 20 (see also FIG. 1.)

In order to suspend the control rod 48 and to ensure its gyratory movement with the ferrule 28 about the axis "O", and at same time to enable the Archimedean screw 56 to perform an independent rotation about its own longitudinal axis, the control rod 48 is suspended by means of a bearing 80 from the ferrule 28 or bearing block 34. Bearing 80, which is of a type well known per se, may comprise a bearing member 82 forming the suspension system, and thus immovable in respect of its own axis, a hub 84 and a roller bearing assembly 86. Hub 84 is affixed to the Archimedean screw 56 via the toothed wheel 64. Hub 84 is capable of rotating in bearing assembly 86 relative to the bearing member 82. Roller bearing 86 consists, in the example described, of a set of swivel stops on rollers supporting both the radial loads and the predominant axial loads.

As may be seen from FIGS. 4 and 5, the articulation point 50 between the control rod 48 and the distribution spout 14 describes a circular arc about the pivoting axis 32 of the spout when the latter is tilted between its two extreme positions. The angle of this circular arc obviously corresponds to the maximum pivoting angle of the spout 14. To enable this movement to take place it is therefore necessary for the control rod 48 to be capable of oscillating through a corresponding angle in a radial plane passing through the axis "O" of the furnace. The magnitude of this oscillating angle of the control rod 48 is a function of that of the pivoting angle and of the length of the said rod. In FIG. 5 the pivoting angle of the spout 14 and the oscillation angle of the rod 48 are marked $\gamma$ and $\beta$ respectively. FIGS. 5 and 6 illustrate a first constructional version of a suspension system enabling the control rod to perform this oscillatory movement. In this version the bearing member 82 of the bearing system 80 is mounted in a U-shaped stirrup 88 of which the free ends are suspended by pivots 90 and 92 from the bearing block 34. This suspension therefore enables the rod 48 to oscillate about an axis defined by the pivots 90 and 92 and parallel to the pivoting axis of the distribution spout 14.

The toothed wheel 64, being affixed to the Archimedean screw 56, oscillates at the same time as the control rod, so that its system of teeth, to enable it to engage the system of teeth 66 correctly during the oscillations, must be curved in the plane of oscillation, i.e. in a radial plane passing through the axis of the toothed wheel 64 and the axis "O" of the furnace. The radius of curvature R of this set of teeth is a function of the magnitude of the angle $\beta$ and the condition to be fulfilled is that the angle of opening which defines this curvature and which is marked $\alpha$ in FIG. 5 must be greater than or equal to the angle.

The aperture 52 in the disc 54 must obviously enable the control rod 48 to perform this pivoting movement, its shape being therefore oblong, in the radial direction, instead of circular.

FIG. 7 shows a second embodiment of a suspension system enabling the control rod 48 to oscillate. In this version the bearing member 82 of the bearing system 80 is rigidly connected to the ferrule, e.g. by means of bolts, while the toothed wheel 64 integral with the hub 84 of the bearing system bears the Archimedean screw 56 by means of a Cardan Joint 94. In view of the position of this joint the pivoting movement of the control rod 48, contrary to the version shown in FIGS. 5 and 6, does not affect the angle of inclination of the toothed wheel 64, so that the system of teeth of this latter can remain plane.

The operation of the charging device clearly emerges from the foregoing description. When the two pinions 42 and 76 are driven synchronously, i.e. at the same speed, the toothed wheels 40 and 68 are likewise driven synchronously. When gear wheels 40 and 68 are driven synchronously the bearing system 72 is not actuated and bearing block 34 is able to rotate together with the two rims 40 and 68, thanks to the bearing system 36. During such synchronous the assembly formed by the ferrule 28, the spout 14, the control rod 48, the bearing block 34, the toothed rims 40 and 68 and the suspension system for the control rod, as well as its toothed wheel 64, gravitates as a unitary structure about the feed channel without the engagement between gear teeth 64 and 66 being in operation. The spout 14 therefore turns with a constant pouring angle about the axis "O", so that the charging material introduced during such a movement is poured over annular surface on the charging surface.

If, on the other hand, the two pinions 42 and 76 rotate at different speeds, this speed difference is transmitted to the toothed rims 40 and 68. This produces relative movement, on bearing 72, between the toothed rim 70 and the bearing block 34. The relative motion sets in operation the gearing engagement between the toothed wheel 64 and the system of teeth 66, so that the Archimedean screw 56 is caused to move about its own longitudinal axis in one direction or the other according to whether the toothed rim 70 is advancing or lagging in relation to the toothed rim 40. The rotation of screw 56 results in a modification of the pouring angle of the distribution spout 14.A judicious selection of angular speeds for the two pinions 42 and 76 therefore enables the rotatory movement and the pivoting movement of the distribution spout 14 to be superimposed on each other, particularly for the purpose of ensuring that the material will be discharged in a spiral trojectory onto the charging surface.

It is naturally also possible for the pinion 42 to be momentarily stopped while the pinion 76 is continuing to rotate, and this causes the spout 14 to perform a tilting movement, its rotation about the axis "O" being held up.

Figure 8:
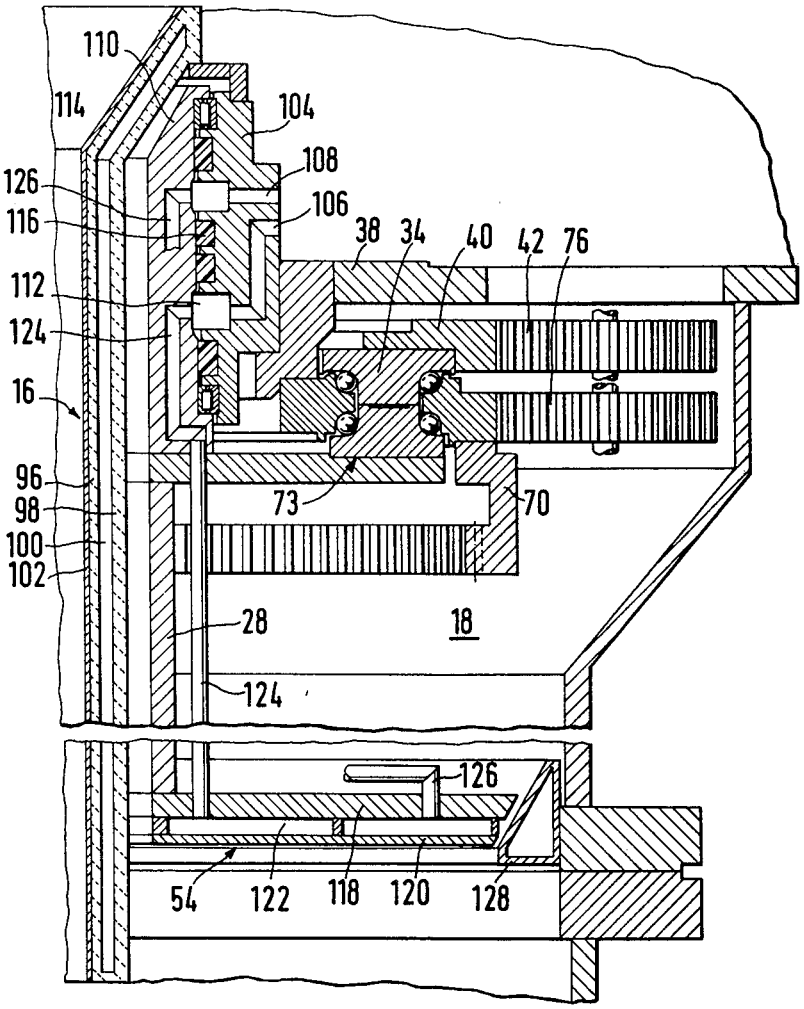
FIG. 8 shows, by means of a schematic sectional diagram, the manner in which different parts of apparatus in accordance with the present invention can be cooled.

It should be noted that the radial width of the annular chamber 18 is determined by the dimensions of the bearing block 34 and that of the toothed rims 40 and 70. Even though to a certain extent a function of the dimensions and capacity of the furnace, the dimensions of the said elements may be comparatively small, enabling the radial width of the annular chamber to be kept moderate. This obviously reduces the width of the disc 54, i.e. the surface directly exposed to the heat prevailing inside the furnace. Furthermore, the influence of the exposure via the feed channel 16 can be kept to a minimum, since, as will be described in greater detail in conjuction with FIG. 8, the wall of this feed channel 16 can be cooled. To effect this cooling it is sufficient, as shown by FIG. 8, to provide a double wall 96, 98, delimiting a space 100 for the circulation of a cooling fluid, such as water. The provision of this cooling involves no technical difficulties, since the feed channel 16 is immovable.

FIG. 8 shows an internal lining 102 for the feed channel. This lining 102 consists of a material of good mechanical strength, enabling it to stand up to the impacts caused by falling charging material, in order to protect the wall of the feed channel 16 and prevent it from prematurely wearing out.

If the operation conditions of the furnace were such that the reduced area of the disc 54, combined with the cooling of the wall of the feed channel 16, did not yet suffice to maintain a sufficiently low temperature in the annular chamber 18, the charging device according to the invention could be additionally cooled on the most exposed surfaces, i.e. the disc 54 and at least part of the rotary ferrule 28.

FIG. 8 shows one example of a supplementary cooling system of this kind. In this embodiment the feed channel 16 is connected to the wall 38 via an annular block 104 provided with a series of admission orifices which are distributed over the circumference of the block 104 in a number which varies according to the volume and delivery of cooling fluid required. This block 104 defines an internal boring in which a prolongation 110 of the ferrule 28 rotates. An admission pipe 106 and an outlet pipe 108 lead into circular grooves 112 and 114 respectively, provided in the boring of the block 104 and having packings 116 along each side in order to ensure hermeticity in the course of operation.

The disc 54 has double walls 118, 120, to define a cavity 122 for the circulation of the cooling fluid. This cooling fluid is introduced into the cavity 122 by means of a pipe 124 partly traversing the prolongation 110 of the ferrule and terminating on a level with the groove 112. A similar pipe, only partly shown and marked 126, enables the cooling fluid to be evacuated through the groove 114. Needless to say, the cavity 112 in the disc 54 can be subdivided by partition into compartments of suitable shape, e.g. spiral, in order to force the circulation through the entire cavity 122.

The speed of circulation in the cooling system for the disc 54 and/or the temperature of the cooling fluid will preferably be selected in accordance with the cooling requirements. The simplest method is to control the operation of this cooling system by means of thermostats and thermocouples, in a manner known per se, and thus automate the cooling system in order to maintain a more or less constant temperature in the chamber 18. This cooling system, in conjunction with the relatively small surface of the disc 54 and thanks to the special design adopted for the spout driving mechanism, makes it possible to dispense with the cooling of the interior of the chamber 18 by means of an inert cooling gas.

It should be noted, however that the cooling of the disc 54 is only an exeptional measure and that the version covered by FIG. 8 has only been illustrated for the sole purpose of indicating how the disc 54 can be cooled if the need should arise. In this context it is advisable to emphasize the advantageous part played by a cooling ring 128, which is affixed, on a level with the disc 54, to the wall 38 of the annular chamber 18. The fact is that this ring 128 enables the width of the moving parts to be kept to a minimum, particularly as regards the disc 54, whereby the fixed parts gain particularly the ring 128 itself, of which the cooling presents no technical problem, since it is sufficient to cause a cooling liquid to circulate in the hollow part inside this ring. The said cooling ring 128 will preferably be triangular in shape, as shown in particular in FIG. 8, to make it easier for the dust deposits to slide inside the furnace. The ring 128 can also be provided with an adjustable securing system, enabling the width of the gap between the disc 54 and the ring 128 to be regulated.

The lubrication of the various internal parts of the annular chamber 18 may be effected, in a manner known pe se, automatically and either at intervals or continuously. In particular, the rotary ferrule 28 may be fitted with a grease reservoir, with a mechanical piston pump capable of being actuated automatically by means of the toothed rim. It is also possible to provide a grease reservoir at the base of the socket 58 and to design the lower end of the Archimedean screw 56 in the form of a piston in order to release a certain quantity of grease through a conduit provided inside the said screw 56 when it is inserted in the socket 58 as far as it will go.

Figure 9:
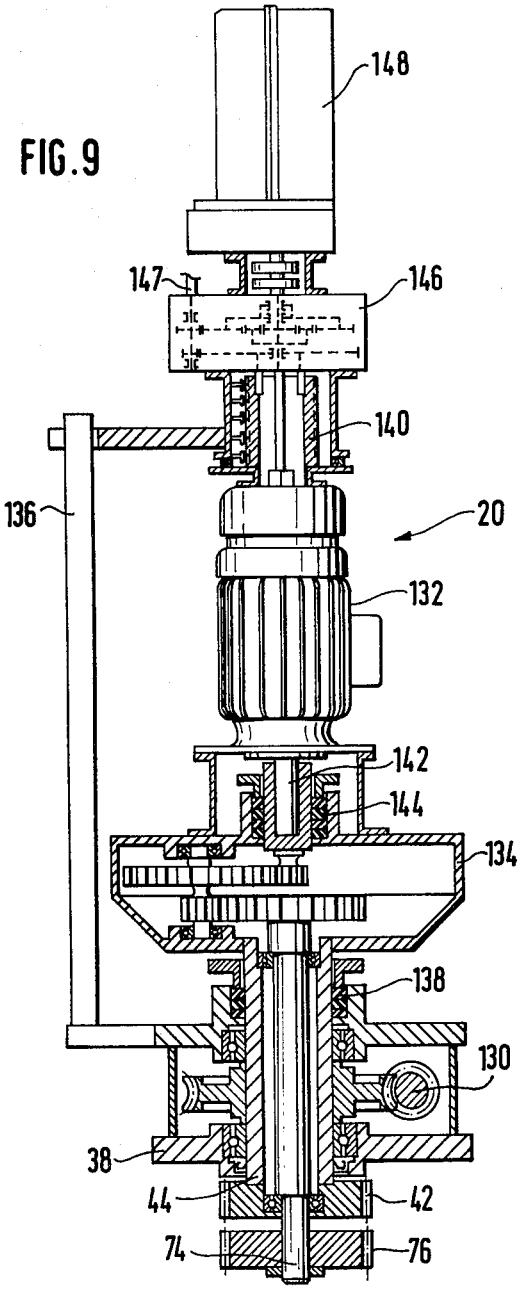
FIG. 9 provides a schematic view of a drive motor assembly for the present invention mounted outside the control chamber.

FIG. 9 provides a schematic diagram of one constructional version of a motor unit 20 serving to drive the two pinions 42 and 76 independently of each other. The first driving system, essentially consisting of a motor, not shown in the drawing, and an endless screw system 130, directly drives the shaft 44 bearing the pinion 42, in order to rotate the ferrule 28 and spout 14 about the vertical axis "0". A second driving system, consisting of a second electric motor 132, integral with a gear case 134 and mounted above the driving system 130, is connected via a stuffing box 138 to the shaft 44 driven by the endless screw 130. The motor 132 is supplied with electric current during its rotation by a friction contact system 140. The output shaft 142 of the motor 132 passes through a stuffing box 144 to the interior of the gear case 134 in order to drive therein a set of reducer pinions consisting of two pairs of pinions, the smaller pinion driving the larger one, in order to obtain the desired reduction in the angular speed. The last of these pinions is affixed to the shaft 74 and therefore directly drives the pinion 76 pivoting the spout 14. It should be noted that both the gear case 134 and the gear case enclosing the endless screw system 130 may contain an oil bath serving to provide satisfactory lubrication.

In operation, when the endless screw 130 is in motion and the motor 132 is not being actuated via the contacts 140, the assembly consisting of the motor unit 132, the gear case 134, the two shafts 44 and 74 and the pinions 42 and 76 rotates as a complete assembly about the vertical axis, in such a way that the two pinions 42 and 76 turn at the same speed, thus driving the spout 14, at a constant angle of inclination, around the longitudinal axis "0" of a furnace. On this combined movement, however, it is possible to superimpose the control for the adjustment of the angle of inclination of the spout, by actuating the motor 132 in such a way as to cause the shaft 74, via the gearing system in the gear case 134, to turn in one direction or the other, thus nullifying the speed synchronism between the pinions. 76 and 42.

It is also possible for the distribution spout 14 to be merely tilted in respect of the longitudinal axis, without causing it to rotate about this latter, by simply actuating the motor 132, the endless screw system 130 remaining inoperative, so that it is only the pinion 76 that turns.

The item marked 146 is a device for simulating and reproducing the tilting movement, based on the detection of the number of real revolutions performed by the motor 132. This simulation system may consist, for example, of a miniaturized set of differential and planetary gearings, serving for the exact reproduction of the real rotation of the motor 132. The movement, thus reproduced, is transmitted to a device 148 for the monitoring and control, whether or not automatic, of the movement of the distribution spout 14. This device 148, needless to say, can also provide the operator with constant information regarding the exact angle of inclination of the spout.

It is also possible to reproduce the gyratory movement of the spout around the vertical axis of the furnace. All that is necessary for this purpose is to provide a second simulation and reproduction system, subordinate to the rotation of the shaft 44. This second system, not shown in the drawing, can be directly associated with the endless-screw control system 130 or with an output shaft 147 of the first device 146.

An antigyratory 136 prevents the rotation of the fixed contacts of the current supply system 140 and of the devices 140, 146 and 148 during the rotation of the motor 132 and of the gear case 134.

What we claim is:

1. An improved charging device for furnaces of the type having a tubular feed channel which directs charge material delivered thereto under the influence of gravity onto a first end of a steerable charge distribution chute, the feed channel having an axis and being circumscribed by a portion of the furnace wall, the improved charging device comprising:

ferrule means, said ferrule means being coaxial with the feed channel, said ferrule means cooperating with the furnace wall portion which circumscribes the feed channel to define an actuator chamber therebetween;

mounting means positioned in said actuator chamber for supporting said ferrule means from the furnace wall, said mounting means including bearing means for permitting rotation of said ferrule means with respect to the furnace wall about the feed channel axis, said bearing means comprising a bearing block affixed to said ferrule means;

heat shield means affixed to said ferrule means, said heat shield means extending outwardly from said ferrule means toward the said furnace wall portion and defining the lower end of the actuator chamber;

means pivotally supporting the distribution chute from said ferrule means whereby the chute will rotate with said ferrule means, said supporting means positioning the chute such that the receiving end thereof is beneath the feed channel;

telescopic control rod means, said control rod means being pivotally connected at a first end to the distribution chute, said control rod means extending through said heat shield means into the actuator chamber, said control rod means including relatively rotatable upper and lower elements, said lower element being articulated to the chute;

first drive means for imparting rotation to said ferrule means, said first drive means being in part positioned in said actuator chamber and being operatively connected to said mounting means bearing means bearing block;

second rotation imparting drive means, said second drive means being in part positioned in said actuator chamber; and means coupling said second drive means to said control rod means upper element to cause rotation thereof to thereby vary the length of said control rod means whereby the distribution chute will pivot on said support means, said second drive means being operable independently of said first drive means, said coupling means being rotatably supported from said mounting means bearing means bearing block.

2. The apparatus of claim 1 wherein said control rod means upper element comprises an Archimedean screw and wherein said control rod means lower element comprises an elongated tubular member having a portion which engages said Archimedean screw.

3. The apparatus of claim 1 wherein said first and second drive means comprise juxtapositioned gears located in said actuator chamber, said gears being affixed to respective of a pair of coaxial drive shafts which extend through a wall of the said chamber, said first drive means further comprising a first ring gear affixed to said mounting means bearing means bearing block, said first ring gear being engaged by one of said drive gears, said second drive means further comprising a second ring gear supported by means of bearings from said bearing block whereby said first and second ring gears are independently rotatable.

4. The apparatus of claim 2 wherein said first and second drive means comprise juxtapositioned gears located in said actuator chamber, said gears being affixed to respective of a pair of coaxial drive shafts which extend through a wall of the said chamber, said first drive means further comprising a first ring gear affixed to said mounting means bearing means bearing block, said first ring gear being engaged by one of said drive gears, said second drive means further comprising a second ring gear supported by means of bearings from said bearing block whereby said first and second ring gears are independently rotatable.

5. The apparatus of claim 3 wherein said mounting means bearing means comprises a differential bearing, said bearing block defining a pair of opposed races of said differential bearing, said first ring gear and said ferrule means being integral with said bearing block.

6. The apparatus of claim 4 wherein said mounting means bearing means comprises a differential bearing, said bearing block defining a pair of opposed races of said differential bearing, said first ring gear and said ferrule means being integral with said bearing block.

7. The apparatus of claim 2 wherein said coupling means tubular member includes a nut which engages said Archimedean screw, a tube which extends through said heat shield means to said distribution chute supporting means and collar means for detachably coupling said nut to said tube.

8. The apparatus of claim 1 wherein said coupling means defines an articulated suspension between said control rod means upper element and said mounting means, said articulated suspension including an annular drive gear and a driven gear having a convex contour, said driven gear meshing with said drive gear and being angularly movable with respect thereto, said coupling means further including means suspending said drive gear from said mounting means bearing means bearing block, and means connecting said driven gear to said control rod means upper element.

9. The apparatus of claim 1 wherein said coupling means comprises a universal joint having a housing and an output shaft rotatable relative thereto, means suspending said universal joint housing from said mounting means bearing means bearing block, means drivingly connecting said second drive means to said output shaft and means connecting said universal joint output shaft to said control rod means upper element whereby said upper element may rotate both in synchronism with and relative to said ferrule means.

10. The apparatus of claim 4 wherein said heat shield means comprises a hollow annular disc and wherein said apparatus further comprises means for delivering a coolant to the interior of said disc.

11. The apparatus of claim 1 further comprising:

cooling ring means affixed to the furnace wall and juxtapositioned to said heat shield means, said cooling ring means having a hollow interior whereby a coolant may be circulated therethrough, said cooling ring means having an upper surface which slopes downwardly with respect to the outer wall of said actuator chamber which is defined by the furnace wall portion.

12. The apparatus of claim 4 further comprises:

cooling ring means affixed to the furnace wall and juxtapositioned to said heat shield means, said cooling ring means having a hollow interior whereby a coolant may be circulated therethrough, said cooling ring means having an upper surface which slopes downwardly with respect to the wall of said actuator chamber which is defined by the furnace wall.

13. The apparatus of claim 1 wherein said first and second drive means respectively comprise motors positioned to the exterior of the furnace, said motors being independently energized, said motors being connected to respective of a pair of coaxial drive shafts which extend into said chamber.

14. The apparatus of claim 4 wherein said first and second drive means comprise respective drive motors positioned to the exterior of the furnace and connected to respective of said drive shafts.

15. The apparatus of claim 14 further comprising:

cooling ring means affixed to the furnace wall and juxtapositioned to said heat shield means, said cooling ring means having a hollow interior whereby a coolant may be circulated therethrough, said cooling ring means having an upper surface which slopes downwardly with respect to the outer wall of said actuator chamber which is defined by the furnace wall portion.

* * * * *